United States Patent [19]

Duddy et al.

[11] Patent Number: 4,784,262

[45] Date of Patent: Nov. 15, 1988

[54] CASSETTE FOR LOOSE-PIECE PARTS SUCH AS ELECTRICAL TERMINALS AND METHOD OF LOADING

[75] Inventors: Gerald J. Duddy, Thousand Oaks, Calif.; William J. Rudy, Jr., Annville; Howard R. Shaffer, Millersburg, both of Pa.

[73] Assignee: AMP Incorporated, Harrisburg, Pa.

[21] Appl. No.: 80,139

[22] Filed: Jul. 31, 1987

[51] Int. Cl.[4] ..... B68D 83/04

[52] U.S. Cl. ..... 206/333; 206/413; 221/70; 221/71

[58] Field of Search ..... 206/330, 343, 408, 411, 206/413; 221/70, 71

[56] References Cited

U.S. PATENT DOCUMENTS

| | | | |
|---|---|---|---|
| 2,604,986 | 7/1952 | Berg | 206/59 |
| 3,170,501 | 2/1965 | Ustin et al. . | |
| 3,254,760 | 6/1966 | Walker | 206/59 |
| 3,283,886 | 11/1966 | Addis et al. | 221/70 |
| 3,367,535 | 2/1968 | Tanguay | 221/71 |
| 3,478,923 | 11/1969 | Fisher | 221/70 |
| 3,584,819 | 6/1971 | Brough | 242/118.61 |
| 4,080,148 | 5/1978 | Wise | 425/576 |
| 4,101,095 | 7/1978 | Carter | 242/115 |
| 4,274,550 | 6/1981 | Feldstein | 221/71 |

FOREIGN PATENT DOCUMENTS

| | | | |
|---|---|---|---|
| 2637931 | 3/1977 | Fed. Rep. of Germany | 221/71 |

OTHER PUBLICATIONS

Crimp-Tec-Inc. brochure, "CTI-300 Automatic Crimping Tool", Crimp-Tec-Inc., Wilmington, Calif. (date unknown).

Crimp-Tec-Inc. brochure, "CTI-500 Contact Magazine", Crimp-Tec-Inc., Wilmington, Calif. (date unknown).

Crimp-Tec-Inc. brochure, "CTI-600 Automatic Magazine Loader", Crimp-Tec-Inc., Wilmington, Calif. (date unknown).

AMP Dispenser Box, Item No. 12008, Instructions; AMP Incorporated, Harrisburg, Pa. (date unknown).

AMP Catalog No. 73-111, "AMP-Tapematic Application Tooling", Rev. 2-77, pp. 1-5, AMP Incorporated, Harrisburg, Pa. (1977).

*Primary Examiner*—Joseph M. Moy

*Attorney, Agent, or Firm*—Anton P. Ness

[57] ABSTRACT

A cassette (12) for loose-piece parts, such as electrical terminals (3), comprising a housing (14) having a storage chamber (22), a feeding portion (32), and a discharge station (38). The parts are mounted in spaced-apart relationship in individual cells (10) of a belt (2) which is wound in a coil in the storage chamber (22). A confined passageway (56) extends from the storage chamber (22) to the feeding portion (32) to guide the belt (2) into the feeding portion where it is engaged by a feeding means on a machine, such as a crimping machine, when the cassette (12) is mounted on the machine. The parts are removed from the cells (10) at a discharge station (38) which may be in the feeding portion (32) of the cassette (12).

19 Claims, 6 Drawing Sheets

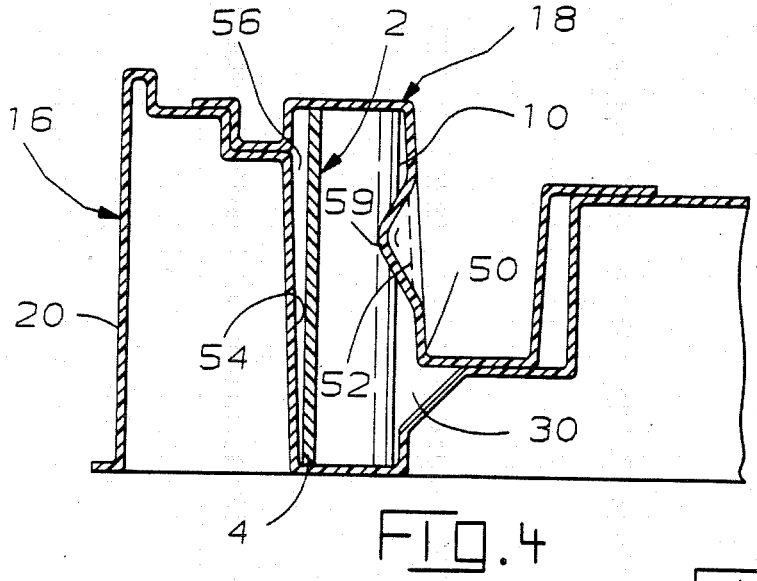
FIG. 4
FIG. 5
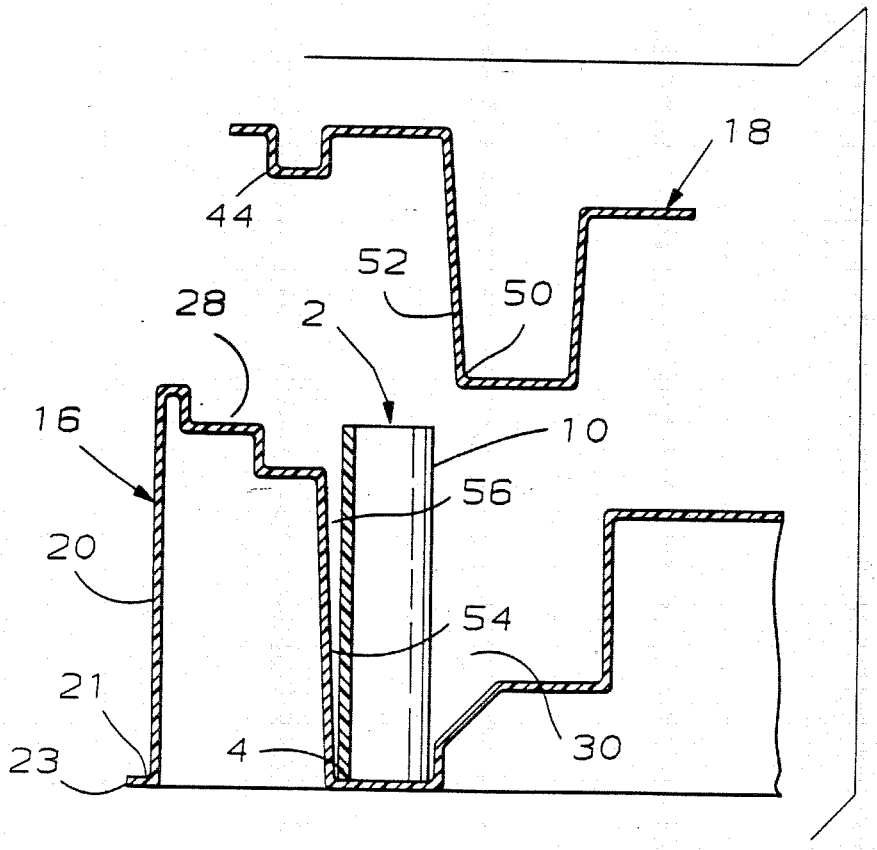

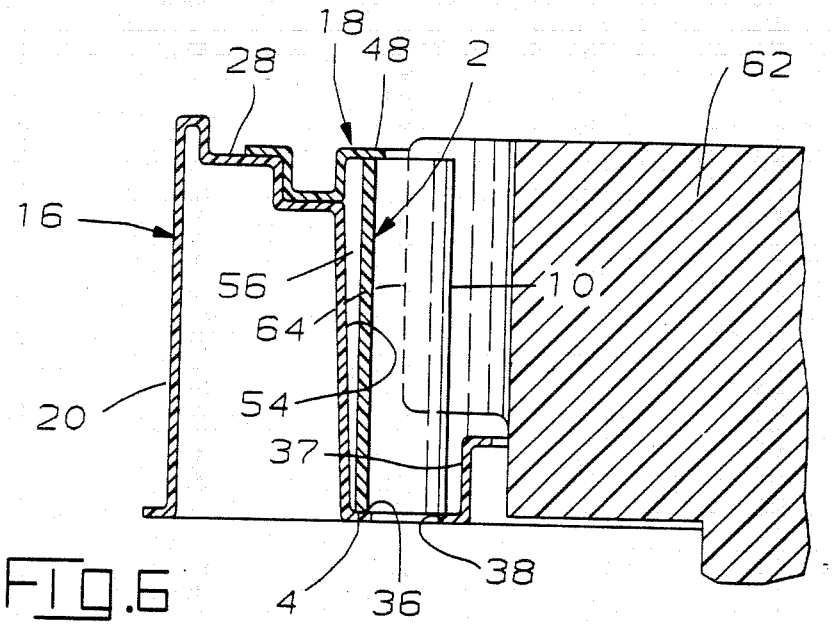
FIG.6
FIG.7
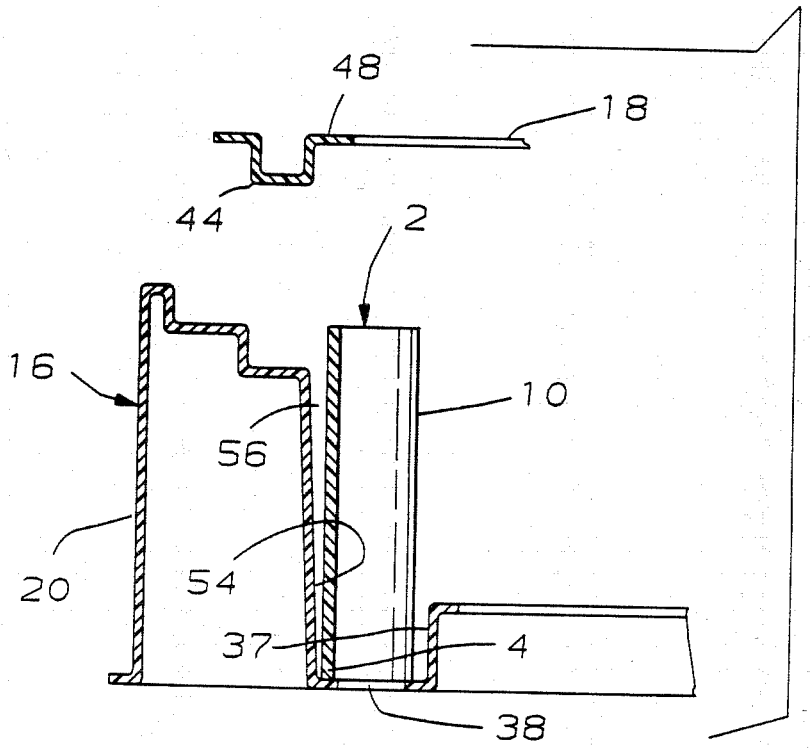

CASSETTE FOR LOOSE-PIECE PARTS SUCH AS ELECTRICAL TERMINALS AND METHOD OF LOADING

FIELD OF THE INVENTION

This invention relates to cassettes of the type which contain loose-piece parts so that the cassette can be mounted on a machine, such as a terminal crimping machine, to permit the parts to be fed to the machine.

BACKGROUND OF THE INVENTION

Many types of small items or parts, such as small electrical terminals, must be produced as loose-piece parts rather than in strip form because of the manner in which each part must be formed. For example, electrical terminals which are manufactured by automatic screw machine operations can only be produced as loose pieces or individual pieces. When such terminals are to be crimped onto wires, it is desirable to package the parts in some way so that they can be fed automatically to a crimping machine. One system presently used is to mount the individual terminals in a continuous belt of plastic or the like enclosed in a cassette-type magazine so that the parts can be individually removed from the magazine exit station as the belt is fed, and both the magazine and belt are reusable. The magazine is removable from the crimping machine after enough parts have been dispensed and is placed back on the machine when needed again, which permits another magazine with different sized parts to be fed into the machine as desired. Such a crimping machine and magazine are sold by Crimp-Tec, Inc. of Wilmington, Calif. under the trade designation CTI-300 and CTI-500 respectively, and a loading apparatus for the magazine is sold under the trade designation CTI-600. The belt is endless and is comprised of a plurality of separately molded cells each connected by hinges and hinge pins to the adjacent cells, and the belt is packed into a storage area with the cell hinges permitting a random orientation of the belt therewithin. The housing is metal and the cover is a thick plastic member secured to it primarily by screw fasteners, to withstand handling and permit visual inspection of the belt within. A feed wheel is contained within the magazine and receives a spindle of the crimping machine to be rotated to pull the belt for the storage chamber; during loading the feed wheel receives a like spindle of a loading machine to be rotated thereby to move the belt in the same direction as belt cells receive terminals at a loading station located past the exit station, whereafter the belt is pushed into the storage area of the magazine.

It is desired to achieve a cassette which can be produced at a minimum cost in a much simpler manufacturing procedure, which can be more efficiently packed, and which provides for control of belt location along a belt path.

SUMMARY OF THE INVENTION

The present invention is directed to the achievement of an improved cassette for small loose-piece parts which can be mounted on a machine, such as a terminal crimping machine, when the parts are placed in service. The invention comprises a cassette containing a belt of loose-piece parts, such as electrical terminals. The belt has parallel side edges and has spaced-apart cells extending between the side edges on one of its major surfaces. Each of the cells contains one of the parts so that the parts can be removed from the belt, either by falling through a discharge aperture at a selected location along the bottom of the surface of the cassette, or upon movement of an ejector or the like into the cell in which the part is contained. The cassette comprises a housing having oppositely-facing major surfaces and a belt storage chamber between the major surfaces. The cassette is characterized in that the housing has a belt feeding portion, a discharge station, and a passageway extending from the storage portion to the feeding portion. The feeding portion comprises a recess extending into one of the major surfaces towards the other surface. The recess has recessed side walls which extend normally of the one major surface and has belt edge supporting surface portions which extend normally of, and from, the recess side walls adjacent to the other major surface. The edge supporting surface portions are dimensioned to support one of the side edges of the belt. The passageway extends from the storage chamber to the recess and is dimensioned to guide the belt from the storage chamber to the recess at a location adjacent to the recess side wall so that the side wall can then guide the belt through the feeding portion to the discharge station. The recess is dimensioned to receive a feeding means such as a toothed wheel which is engageable with the belt so that when the cassette is put to use, it is merely necessary to mount the cassette on the machine with which it is being used and the feeding means will come into engagement with the belt.

In accordance with the present invention, the storage chamber is cylindrical and has a centrally located chamber axis, the belt being spirally wound in the chamber on the axis. The feeding portion is preferably also cylindrical and has a feeding portion axis which is parallel to the storage chamber axis. The passageway extends tangentially from the storage chamber and tangentially to the feeding portion. The belt has enought stiffness to tend to straighten out and move toward the side wall of the storage chamber, and enter the passageway tangentially to its spiral configuration which facilitates entry into the passageway and eliminates snagging.

According to another feature of the invention, a boss is formed in the cover after loading, along the belt passageway and extending between adjacent cells, holding the belt in a fixed position during handling; and the boss is deflectable by the cells when the belt is pulled, permitting feeding of the belt to the discharge station during use. The boss holds a leading end of the belt after loading in position to be engaged by the feeding means.

It is an objective of the present invention to provide a cassette for storing and enabling dispensing of loose-piece parts to facilitate the function of apparatus requiring the parts to perform a work step.

It is a further objective to provide a cassette which is so economical to produce that the empty cassette may be discarded after use.

It is yet another objective to provide a cassette which keeps the belt stored therein in an organized disposition to optimize packing density and also to facilitate movement of the belt during dispensing, and which also assuredly locates the leading end of the belt to be engaged by feeding means of the apparatus.

THE DRAWING FIGURES

FIG. 4 is a cross-sectional view looking in the direction of the arrows 4—4 of FIG. 3.

FIG. 5 is a view similar to FIG. 4 but showing the parts exploded from each other.

FIG. 6 is a cross-sectional view looking in the direction of the arrows 6—6 of FIG. 3, and also showing a portion of a feed wheel.

FIG. 7 is a view similar to FIG. 6 but showing the cover portion exploded from the body portion.

THE DISCLOSED EMBODIMENT

Figure 1:
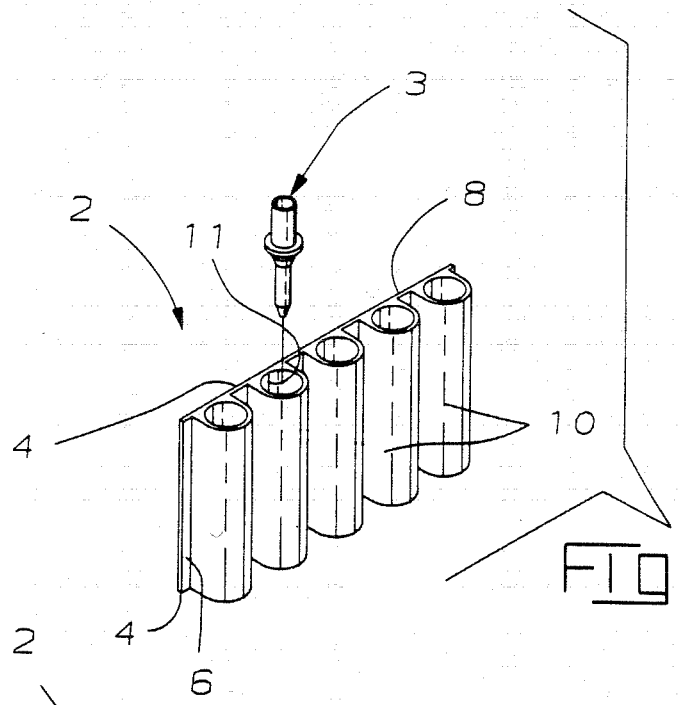
FIG. 1 is a view of a short section of a belt containing small parts such as electrical terminals.

The embodiment of the invention described below is intended to contain a section of a belt 2 in which are held electrical terminals 3 so that the terminals can be fed to a machine such as a crimping machine when the terminals are to be crimped onto wires. The belt 2 has parallel side edges 4, and oppositely-facing major surfaces 6,8. A plurality of spaced-apart cells 10 are provided on the surface 6, these cells being in the form of hollow projections which are spaced apart along a web and which are dimensioned to contain an individual terminal or the like so that the individual terminals can be removed either by gravity or upon movement of an ejector into the cells. Belt 2 can be economically molded of, for example, polypropylene in a known continuous molding process such as is disclosed in U.S. Pat. No. 4,080,148.

The cassette assembly 12 comprises a housing assembly 14 which contains a substantial length of belt material 2 as will be described below. The housing assembly 14 comprises a housing body 16 and a housing cover 18. Both of these housing parts 16,18 can be produced of a suitable plastic material by a vacuum molding process, for example, styrene, and they are advantageously relatively thin, for example, 0.03 inches, so that a minimum amount of plastic material will be used in their manufacture.

The housing body 16 has an outer side wall 20 which extends almost completely around the cassette as shown and which has a lower edge 21 (as viewed in FIGS. 2 and 3) from which a short flange 23 extends. This flange and other flanges on the cover member serve to stiffen the housing notwithstanding the extreme thinness of the plastic. The housing body has a cylindrical belt storage chamber 22 which has a storage chamber side wall 24 that extends normally of the upper and lower major surfaces of the cassette assembly. The storage chamber side wall 24 is spaced from the outer side wall 20 and the storage chamber has an inner end or floor 26 which constitutes the lower major surface of the cassette assembly.

A stepped connecting section 28 extends between the upper edge of the spaced-apart side walls 20,24 and is dimensioned to receive a complementary stepped or contoured edge portion of the housing cover 18 as will be described below. An enlarged passageway 30 extends tangentially from the storage chamber 22 to the feeding portion 32 of the cassette assembly and this feeding portion is also cylindrical, although it has a considerably smaller diameter than does the storage portion. Feeding portion 32 has a feeding portion side wall 34, the lower edge portion 35 of which has flange 36 extending inwardly to an upwardly-extending retention wall portion 37. Flange 36 functions as a supporting surface for one of the edges 4 of the belt as it is fed into and through the feeding portion, while retention wall portion 37 serves to retain belt 2 adjacent side wall 34, as shown in FIG. 6.

Figure 9:
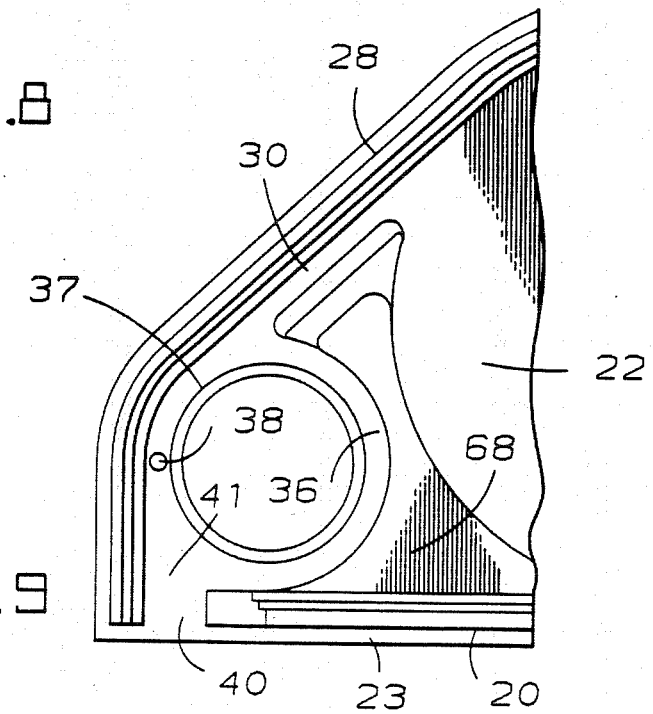
FIG. 9 is a plan view of the portion of the housing body which contains the belt feeding portion.

The discharge station for the individual terminals is contained in the feeding portion and a circular opening or exit station 38 is provided in the flange at the discharge portion, FIG. 9. This circular opening 38 permits, in one method of use, an ejector to move into the cells individually as they move past the discharge station and push the individual terminals from the belt, through the opening 38, and to the crimping machine.

Alternatively, the use of an ejector can be avoided by dimensioning and shaping cells 10 of belt 2 such that the terminals 3 will fall out of the cassette at the ejection station under the influence of gravity, such as if cells 10 have right cylindrical inner surfaces 11 open at both top and bottom, or if the lower portions of cells 10 have a slightly larger inside diameter than the upper portions. In such an embodiment inside major surfaces of housing body 16 and cover member 18 adjacent belt 2 act to close off the top and bottom of cells 10 and therefore must be smoothly continuous and adjacent both top and bottom edges 4 of belt 2 in storage chamber 24, passageway 30, and feeding portion 32. In such a belt embodiment, the belt can be integrally molded in continuous strip such as in the molding process described in U.S. Pat. No. 4,080,148.

The outer side wall 20 extends around the entire cassette housing; however, it is discontinuous adjacent to the feeding portion so that an opening 40 is provided through which the belt material can be fed from the cassette after the belt has been fed past the discharge station. A gusset section 41 is provided in this section and extends across the gap in side wall 20 which defines the discharge opening for the belt material.

The cover 18 is of a shape to match the shape of the housing and has a peripheral edge 44 which is dimensioned snugly to fit within the stepped connecting section 28 of the housing body 16. A circular opening 46 is provided in the feeding portion of the cassette so that a gear-like feed wheel 62 (FIG. 8) can be inserted into feeding portion 32 after the cassette is mounted on a crimping machine or the like. A lip 48 extends inwardly of this opening on the upper surface of the cassette assembly and functions to retain the belt in the feeding portion prior to placement of the cassette on the crimping machine. Lip 48 should be relatively narrow so that it will not interfere with placement of the feed wheel in the circular opening of the feeding portion.

A projection 50 is provided on the underside, as viewed in the drawings, of cover member 18 and is dimensioned to fit into the enlarged passageway 30 in the housing body which extends from the storage chamber to the feeding portion. As seen in FIG. 4, projection 50 has a side wall 52 which is opposed to a side wall portion 54 of the enlarged passageway 30 so that a relatively more narrow belt feeding passageway 56 is defined which extends from the storage chamber to the feeding portion. As shown in the drawing, this belt feeding passageway strictly confines the belt and guides it accurately into the feeding portion. It is preferred that a bubble-like retention boss 59 be formed, such as by localized heating and forming, along passageway 56 extending outwardly to protrude between adjacent cells 10 of belt 2 which acts to inhibit undesired movement of belt 2. Boss 59 in cover 18 of thin styrene is inwardly deflectable by succeeding cells 10 passing thereagainst as belt 2 is being fed into and through feeding portion 32; and boss 59 also during handling retains a leading end of belt 2 in position along its path to be engaged by feed wheel 62.

Figure 3:
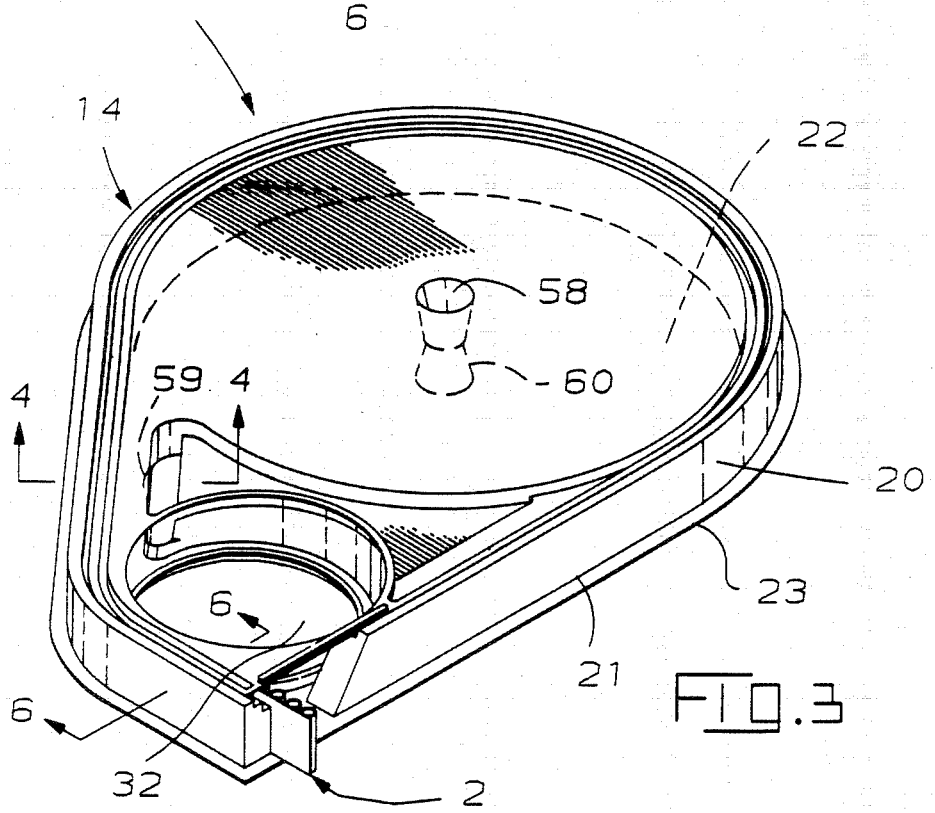
FIG. 3 is a perspective view showing the cover and body portions in their assembled relationship.
Figure 2:
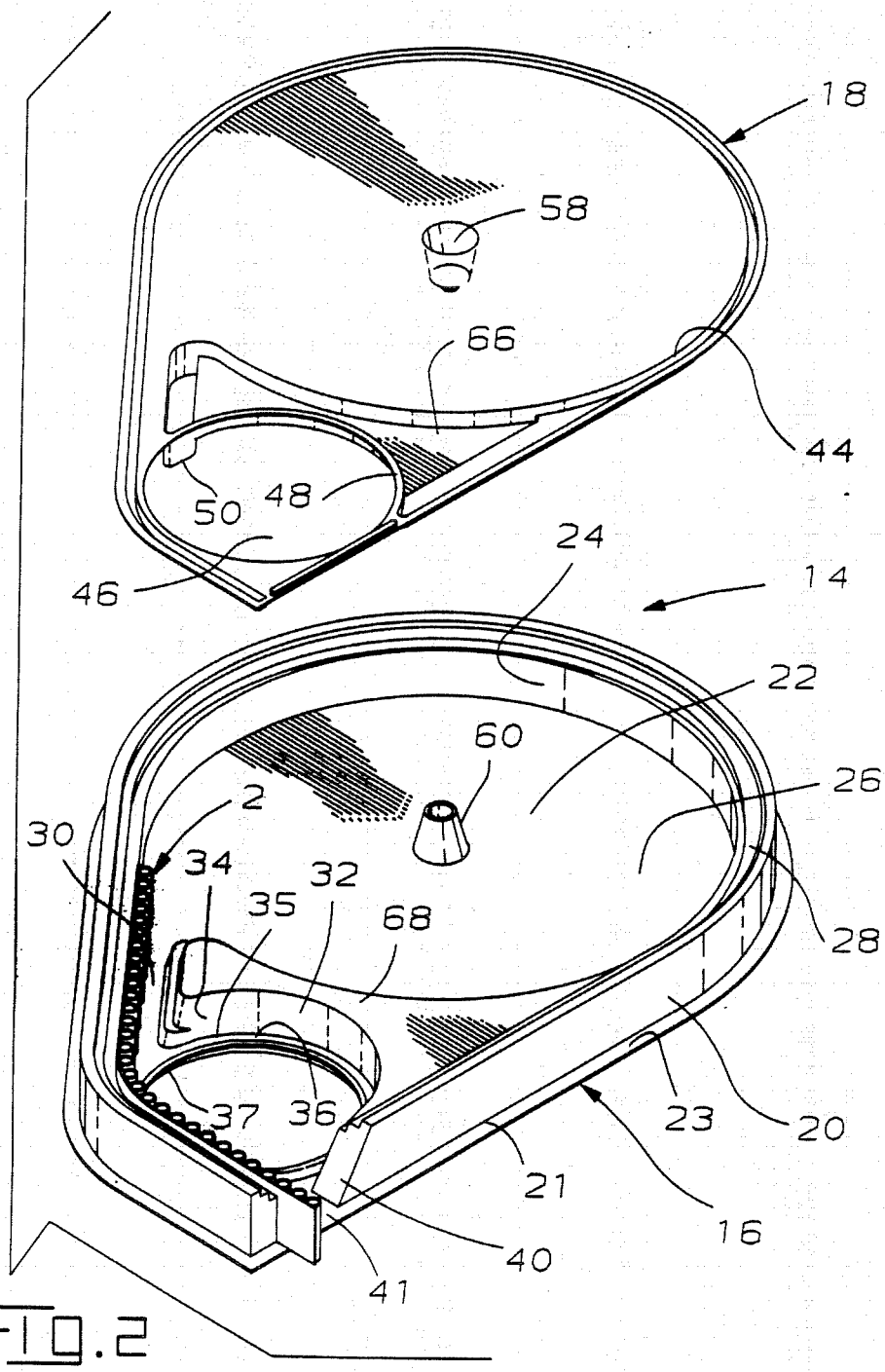
FIG. 2 is a perspective exploded view showing the body portion and the cover portion of the cassette housing.

With reference to FIGS. 2 and 3, cover member 18 has a central inwardly directed projection 58 which is centrally located with respect to storage chamber 22, and a similar inwardly projecting boss is provided on housing body 16 as shown at 60. The ends of these frustoconical projections 58,60 which are within storage chamber 22, are against each other and are boned to each other to secure the parts to each other. The cover can be bonded to the housing body at additional locations at the time of assembly, for example, along the stepped connecting section 28 and the edge of the cover member. These projections also provide recesses on the upwardly and downwardly-facing major surfaces of the cassette which can be employed when the cassette is mounted on a crimping machine or at other times when the cassette must be precisely positioned as for example, when it is loaded with belt material.

Figure 8:
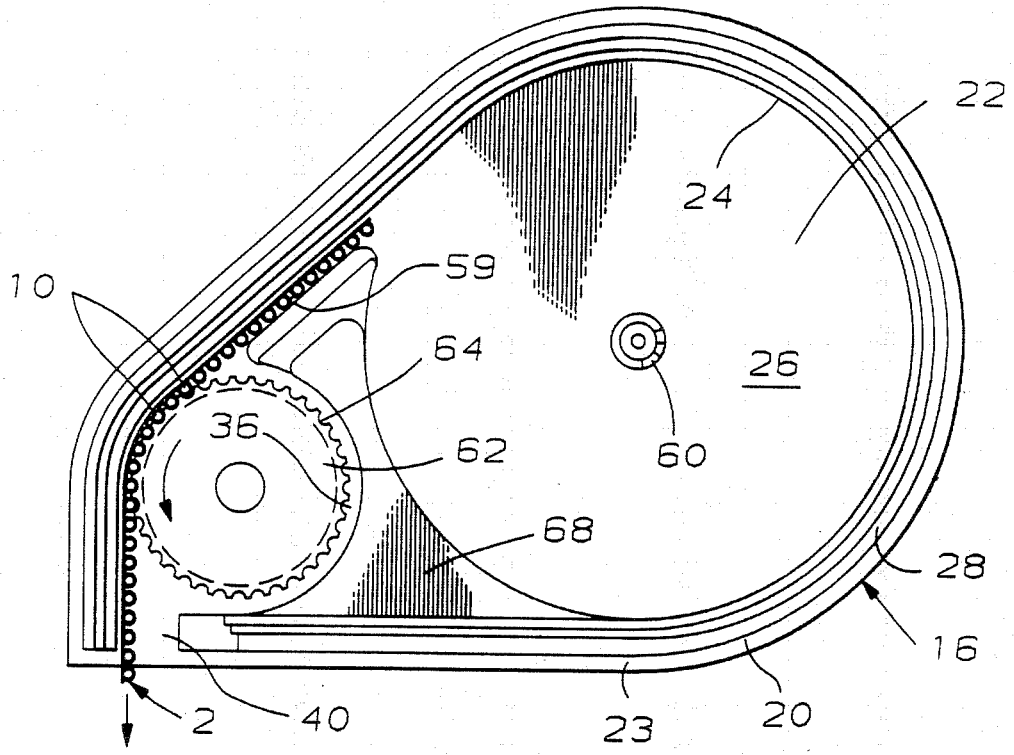
FIG. 8 is a plan view of the cassette and showing the position of the feed wheel for the belt contained in the cassette.

As shown in FIGS. 6 and 8, the feed wheel or gear 62 is removably mounted on a rotatable shaft in the crimping machine (not specifically shown) and is dimensioned to fit snugly within the circular opening of the feeding portion of the cassette. When cassette 12 is mounted on the machine and feed wheel 62 is then mounted in the cassette feeding portion to the machine, teeth 64 of the feed wheel will move between adjacent cells 10 of belt 2 above retention wall portion 37, and upon rotation of the feed wheel, the belt will be fed. Under normal circumstances, the feed wheel would be intermittently rotated by an amount sufficient to feed the belt a distance equal to the spacing between adjacent cells 10 on the belt.

Figure 10:
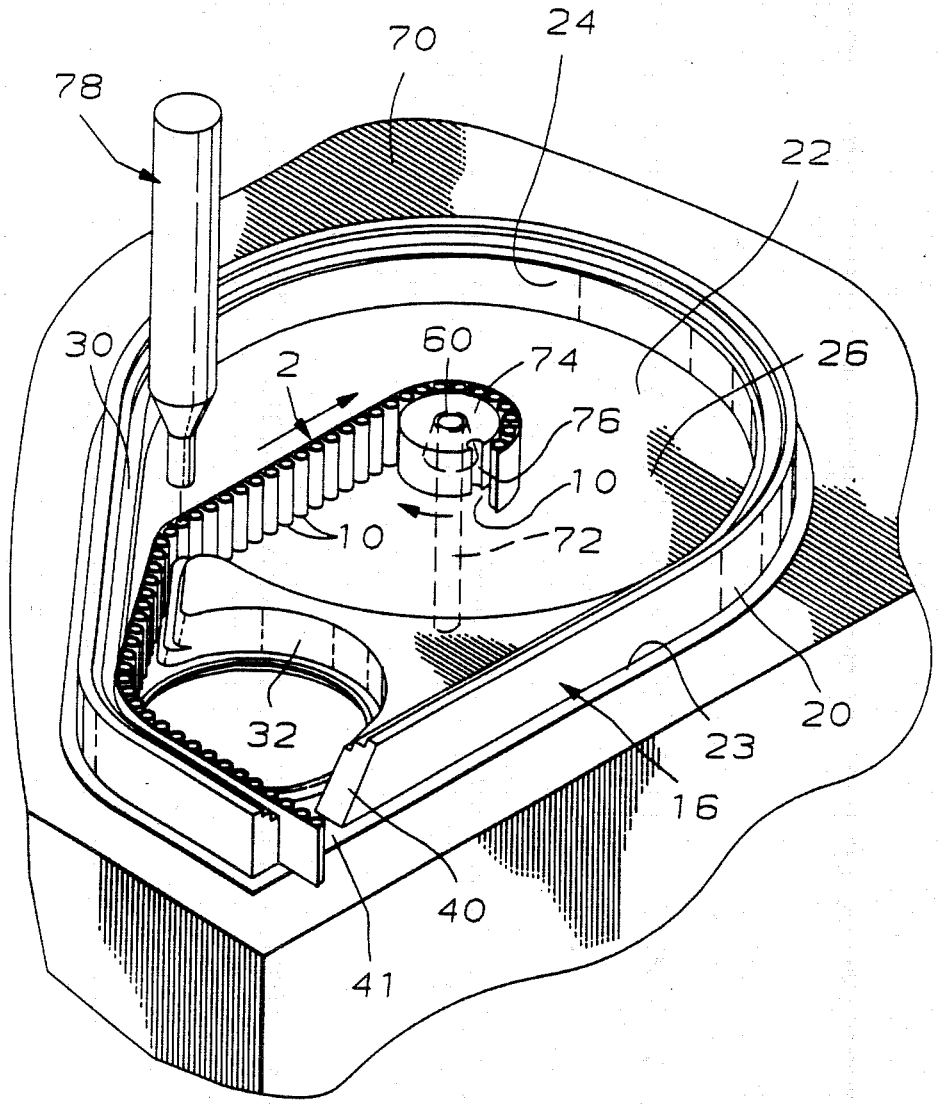
FIG. 10 illustrates the belt being spirally wound in the storage chamber, and terminals being simultaneously loaded into the belt.

A preferred method of loading cassette assembly 12, as shown in FIG. 10, involves housing 16 placed on a platform 70 with a rotatable shaft 72 extending upwardly through the top of boss 60 to rotatably engage a head 74 placed over boss 60. Head 74 has a vertical cell holding channel 76 to hold a first cell 10 of belt 2 therein during loading, and as head 74 is rotated in a clockwise direction, belt 2 is pulled continuously into storage chamber 22 via belt passageway 30 and is spirally wound about head 74 in loops of increasing diameter. As belt 2 is wound, each cell 10 passes a loading station 78 to receive a loose terminal inserted thereinto by loading tooling. Preferably, as belt 2 is wound into a spiral and the spiral outer diameter increases, the angular speed of head 74 is gradually slowed to maintain the belt speed constant at the outside of the spiral and thus constant at loading station 78 to facilitate loading. Head 74 is then removed from boss 60 and disengaged from the first cell of belt 2 upon completion of the loading procedure, and cover member 18 is then placed and secured onto housing 16, and boss 59 formed along narrow passageway 56 to stabilize the end portion of belt 2 during handling. The embodiment of the belt used in the present invention preferably has moderate stiffness, tending to straighten itself. This innate stiffness is desirable in that the belt tends to dispose itself around the periphery of the storage chamber after partial use, which keeps the portion of the belt about to enter the belt passageway aligned with the passageway to eliminate snagging.

The embodiment of the invention shown exhibits good design practice from the standpoint of minimizing the amount of plastic needed for the cassette and maximizing the strength and rigidity of the assembled cassette housing. As mentioned previously, the plastic material may have a thickness of as little as 0.03 inches. In order to lend rigidity to the cassette assembly proximate feeding portion 32, depressions 66 and 68 are provided into the outwardly-facing major surfaces of cover member 18 and housing body 16 respectively, as shown in FIG. 2, and the internal surfaces provided by these depressions are against each other when the cover is assembled to the housing body. Depressions 66,68 and other features which are apparent from inspection of the drawing provide plastic housing surfaces which extend normally of the major surfaces of the housing and contribute to the overall rigidity of the assembly.

It will be apparent from the foregoing description that the principals of the invention will result in the achievement of a cassette which can be manufactured at a minimum cost, is easily loaded with a maximum number of parts, and will occupy a minimum amount of space beyond that required by the belt material itself. At the same time, the cassette can be mounted on a crimping machine in a simple procedure, and removed and remounted as desired; and it will protect the terminals from damage during normal handling or shipment. Its design minimizes the possibility of the belt snagging during in-service use. Finally, the low cost of the cassette and the small amount of material involved in its manufacture render it a device which can be discarded after use rather than being refilled.

What is claimed is:

1. A cassette for containing loose-piece parts for automated dispensing into a machine, the loose-piece parts being contained in a belt within the cassette, the belt having parallel side edges and having spaced-apart cells extending between the side edges, each of the cells containing one of the parts and being open at least at a relative bottom end in a manner permitting and facilitating removal of a said part therefrom while the cell is within the cassette, the cassette comprising a housing having oppositely-facing major surfaces, side walls therebetween, a belt storage chamber, a belt feeding portion, a part discharge station, and a belt passageway extending from the storage portion to the feeding portion, a relative bottom one of the housing major surfaces supports a relative bottom side edge of the belt within the storage chamber and the passageway and includes an edge supporting surface portion in the feeding portion enabling movement of the belt along a feed path during in-service use, and the feeding portion comprises a recess through the housing major surfaces shaped and dimensioned to receive a feeding means of the machine to engage the belt disposed adjacent a side wall of the recess and move the belt forwardly along the feed path, the cassette being characterized in that:

the storage chamber is cylindrical and has a centrally located chamber axis defined by axis projection means extending between said major housing surfaces, and the belt is spirally wound in the storage chamber about said axis projection means.

2. A cassette as set forth in claim 1 further characterized in that said belt passageway is tangential to the side wall of said storage chamber.

3. A cassette as set forth in claim 2 further characterized in that said feeding portion is cylindrical about a feeding portion axis parallel to said storage chamber axis, and said belt passageway is tangential to the side wall of said feeding portion.

4. A cassette as set forth in claim 1 further characterized in that said housing includes a belt-engaging boss for securing said belt in a fixed position along said belt path and being deflectable by said belt relatively away from said belt to permit movement of said belt by said feeding means.

5. A cassette as set forth in claim 4 further characterized in that said belt-engaging boss is disposed along a side wall of said belt passageway and extends toward an opposing side wall thereof to define a construction less than the width of said belt at a cell location, whereby said belt is held by said belt-engaging boss against said opposing side wall.

6. A cassette as set forth in claim 1 further characterized in that said part discharge station is located in the feeding portion and comprises an opening in said edge supporting surface portion whereby individual parts can be removed from respective cells of said belt passing thereover.

7. A cassette as set forth in claim 6 wherein said feeding portion includes an upstanding wall portion along an inner edge of said edge supporting surface portion for retaining said belt along and adjacent a side wall of said feeding portion.

8. A cassette as set forth in claim 1 further characterized in that a retaining lip is provided in said feeding portion for retaining said belt thereon, said lip extending radially inwardly of said recess opposed from said edge supporting surface to extend over at least part of the width of said belt.

9. A cassette as set forth in claim 1 further characterized in that said housing is comprised of a molded plastic body including one of said major surfaces and a molded plastic cover portion including the other of said major surfaces, and both being vacuum-formed, with said storage chamber, said recess, and said edge supporting surface being in said body portion.

10. A cassette as set forth in claim 9 characterized in that an enlarged passageway is provided in said body portion extending from said storage chamber to said feeding portion, said cover portion has a projection thereon which is received in said enlarged passageway, and said enlarged passageway and said projection have opposed spaced-apart surface portions which define said belt passageway.

11. A cassette as set forth in claim 9 characterized in that said cover portion ad said body portion have opposed inwardly directed storage chamber axis projections which are bonded to each other thereby securing said body portion to said cover portion, said axis projections defining recesses on said major surfaces of said housing for reception of axis means when said cassette is mounted on a crimping machine or the like.

12. A cassette as set forth in claim 1 further characterized in that said belt comprises an integral web having oppositely-facing major web surfaces, said cells disposed on one of said web surfaces.

13. A cassette as set forth in claim 12 further characterized in that each said cell defines a part-receiving aperture therethrough, and the inner surface of said aperture is adapted to permit a said part to fall downwardly therethrough for removal therefrom, said part being retained therein by a bottom one of said major surfaces of said housing after insertion thereinto and prior to dispensing of said part.

14. A cassette as set forth in claim 12 further characterized in that said cells extend along an inside one of said major web surfaces after said belt is spirally disposed in said storage chamber, and the outer one of said major web surfaces faces towards a side wall of said storage chamber and an outer side wall of said belt passageway and said recess, whereby said cells face inwardly of said feeding portion for engagement by said feeding means.

15. A cassette as set forth in claim 14 further characterized in that said web of said belt has sufficient stiffness to urge the spirally-wound portion of said belt outwardly against said side wall of said storage chamber, whereby the portion of said belt about to enter said belt passageway is aligned therewith when said belt passageway is tangential to said storage chamber side wall at their junction to facilitate said belt entering said belt passageway from said storage chamber.

16. A method of forming and loading a cassette for containing loose-piece parts for being stored therein and dispensed therefrom, comprising the steps of:

forming a length of belt having spaced-apart vertical cells for containing respective loose-piece parts;

forming a housing body portion having a relatively bottom major surface and side wall sections extending upwardly therefrom, said body portion including a cylindrical storage chamber defined by storage chamber side walls about a storage chamber axis;

forming a projection along said storage chamber axis upwardly from said bottom major surface;

placing a winding means over and around said projection, said winding means having a diameter larger than said projection and including a belt-holding means at a selected angular location about the circumference thereof;

securing an end of said belt to said winding means;

rotating said winding means in a selected direction, spirally winding said belt in a coil therearound;

loading loose-piece parts into respective belt cells during said winding; and securing a cover portion to said housing body portion thereby securing said belt in said storage chamber.

17. A method as set forth in claim 16 wherein said housing body portion and said cover portion define a belt passageway extending from said storage chamber to a dispensing location, and one of said cover portion and said housing body portion is formed to include a belt-engaging indexing projection to hold said belt at a fixed location along a belt path when not in service and to permit movement of said belt during in-service use.

18. A method as set forth in claim 16 wherein said winding means is removed from said belt and said housing body portion upon completion of said winding and loading steps.

19. A method as set forth in claim 16 wherein said belt cells pass a fixed loading location and said rotating is varied in speed to maintain a constant speed of said belt cells past said loading location as said spirally wound portion of said belt increases in diameter, to facilitate part loading.

* * * * *